United States Patent [19]

Taguchi

[11] Patent Number: 4,991,215

[45] Date of Patent: Feb. 5, 1991

[54] MULTI-PULSE CODING APPARATUS WITH A REDUCED BIT RATE

[75] Inventor: Tetsu Taguchi, Tokyo, Japan

[73] Assignee: NEC Corporation, Tokyo, Japan

[21] Appl. No.: 421,314

[22] Filed: Oct. 13, 1989

Related U.S. Application Data

[63] Continuation of Ser. No. 38,730, Apr. 15, 1987, abandoned.

[30] Foreign Application Priority Data

Apr. 15, 1986 [JP] Japan ..... 61-87423
May 27, 1986 [JP] Japan ..... 61-122689

[51] Int. Cl.[5] ..... G10L 7/02
[52] U.S. Cl. ..... 381/38
[58] Field of Search ..... 381/29–41, 381/49; 375/122; 364/513.5

[56] References Cited

U.S. PATENT DOCUMENTS

| | | | |
|---|---|---|---|
| 4,472,832 | 9/1984 | Atal et al. | 381/40 |
| 4,588,979 | 5/1986 | Adams | 364/724 |
| 4,669,120 | 5/1987 | Ono | 381/40 |
| 4,701,954 | 10/1987 | Atal | 381/49 |
| 4,716,592 | 12/1987 | Ozawa et al. | 381/40 |
| 4,724,535 | 2/1988 | Ono | 381/31 |
| 4,736,428 | 4/1988 | Deprettere et al. | 381/38 |
| 4,752,956 | 6/1988 | Sluijter | 381/38 |

OTHER PUBLICATIONS

Rabiner et al., "Digital Processing of Speech Signals", Prentice-Hall, 1978, pp. 26–31.

Kroon et al., "Experimental Evaluation of Different approaches to the Multi-pulse Coder", ICASSP 84, 10.4.1–10.4.4.

Sharad et al., "Inproving Performance of Multi-Pulse LPC Coders Low Bit Rates", ICASSP 84, pp. 1.3.1–1.3.4.

Berouti et al., "Efficient Computation and Encoding of the Multipulse Excitation for LPC", ICASSP 84, pp. 10.1.1–10.1.4.

*Primary Examiner*—Dale M. Shaw
*Assistant Examiner*—John A. Merecki
*Attorney, Agent, or Firm*—Foley & Lardner, Schwartz, Jeffery, Schwaab, Mack, Blumenthal & Evans

[57] ABSTRACT

An input speech signal is converted into sampled data with a first sampling frequency in each of a plurality of analysis frames. The sampled data are produced as filtered data through a digital filter having a high cut-off frequency smaller than the highest frequency of the speech signal. The filtered data are decimated into decimated signals which are sampled at a second sampling frequency smaller than the first sampling frequency and which are used to develop multi-pulses representative of an exciting source information of the input speech signal. Each of the analysis frames is divided into a plurality of subframes. At most one multi-pulse is developed in one subframe and the other multi-pulses are subsequently developed for the subframes other than the subframe where the one multi-pulse has been developed.

17 Claims, 8 Drawing Sheets

MULTI-PULSE CODING APPARATUS WITH A REDUCED BIT RATE

This application is a continuation of application Ser. No. 07/038,730, filed Apr. 15, 1987, now abandoned.

BACKGROUND OF THE INVENTION

The present invention relates to a speech processing apparatus and, more particularly, to a linear predictive type speech analysis and synthesis apparatus capable of lowering the bit rate and improving synthesized speech quality by making use of multi-pulses as its speech information.

The vocoder can encode a speech signal within a very narrow bandwidth in which a linear prediction coefficient (called "LPC coefficient") as a spectrum envelope parameter, and exciting source information, including a voice/unvoiced discrimating signal, are transmitted from an analysis side to a synthesis side, and a synthesized speech signal is obtained by using a digital synthesis filter having filter coefficients determined by the LPC coefficients and driven by the exciting source signal.

Such a vocoder can encode a speech signal within a very narrow bandwidth at a low bit rate of 1,200 to 2,400 bps (i.e., bit per second). However, these conventional vocoders have a problem of poor synthesized speech quality due to the simplicity of the speech generation model and the difficulty in an accurate pitch extraction.

To solve the above problem, there has been proposed a multi-pulse vocoder. A vocoder of this type expresses the exciting source information by a plurality of pulses, i.e., multi-pulses regardless of whether the speech is voiced or unvoiced, to utilize the waveform information of the speech signal so that the synthesized speech quality is remarkably improved. This type of vocoder, on the other hand, causes another problem of a increase in coding rate (bit rate).

SUMMARY OF THE INVENTION

It is, therefore, an object of the present invention to provide a speech analysis and synthesis apparatus operable with a low bit rate.

Another object of the present invention is to provide a speech analysis and synthesis apparatus capable of improving synthesized speech quality with a low bit rate.

According to the present invention, an input speech signal for each analysis frame is converted into a first frequency sampled data is filtered by a digital filter having a high cut-off frequency lower than the highest frequency of the speech signal. After converting the filtered data into a second frequency (lower than the first frequency) sampled data, multi-pulses, representative of exciting source information of the input speech, are developed from the second frequency sampled data. The analysis frame is divided into a plurality of subframes. At most one multi-pulse is developed in one subframe and the other multi-pulses are subsequently developed for the subframes other than the subframe where the one multi-pulse has been developed.

Other objects and features of the present invention will become apparent from the following description taken with reference to the accompanying drawings.

DETAILED DESCRIPTION OF THE PREFERRED EMBODIMENTS

Figure 1:
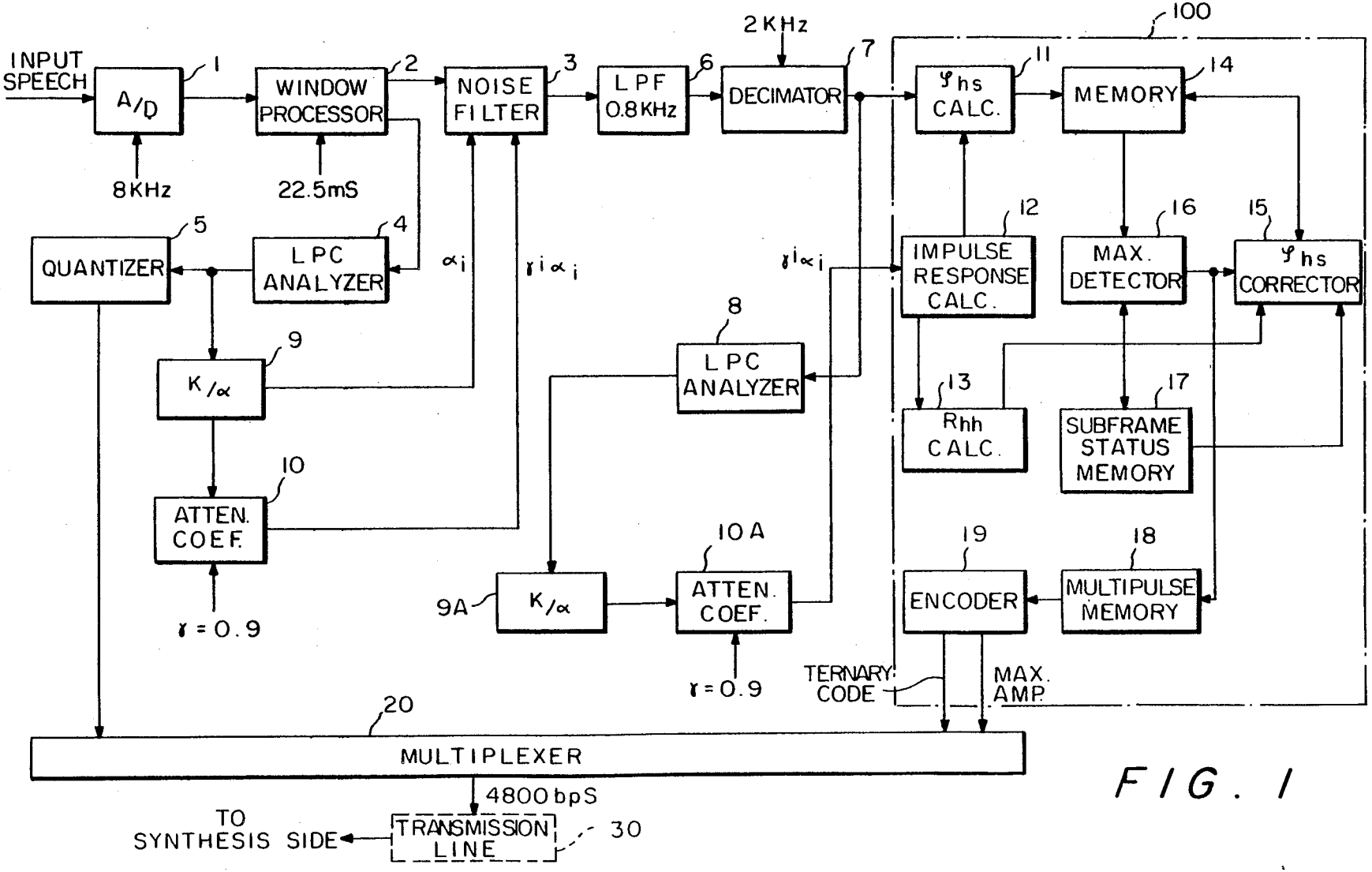
FIG. 1 is a block diagram showing the structure of an analysis side according to one embodiment of the present invention.

At the analysis side of one embodiment of the present invention shown in FIG. 1, an A/D converter 1 filters a speech input with a high cut-off frequency of 3.4 KHz by a built-in LPF (i.e., Low Pass Filter), and then samples the signal with a sampling frequency of 8 KHz to supply a sampled and quantized speech signal of 12 bits to a window processor 2.

The window processor 2 stores the quantized speech signal of a constant period, e.g., 30 msec or 240 samples, performs window processing on the stored quantized speech signal for each analysis frame by multiplying the quantized speech signal by a window function such as the Humming or rectangular function, and supplies the multiplied signal to a noise weighted filter 3 and an LPC analyzer 4.

The LPC analyzer 4 performs an LPC analysis on the signal from the window processor 2 to extract LPC coefficients up to a predetermined order. In the present embodiment, K parameter of tenth order, i.e., PARCOR, or partial autocorrelation coefficients $K_1$ to $K_{10}$ are extracted as the LPC coefficients and are fed to a quantizer 5 and a $K/\alpha$ converter 9. After the quantization, the K parameters are encoded and outputted to a multiplexer 20.

The noise weighted filter 3 weights the signal from the window processor 2 in accordance with the predetermined auditory characteristics. In these weighting processes based upon the auditory characteristics, the quantized noise spectrum of the input speech signal is processed to resemble the intrinsic spectrum to reduce the auditory noises by the masking effect. A transfer function, W(Z) of the noise weighted filter to be used for this reduction is expressed by the following equation (1):

$$W(Z) = \left[1 + \sum_{i=1}^{p} \alpha_i Z^{-1}\right] / \left[1 + \sum_{i=1}^{p} \gamma^i \alpha_i A^{-1}\right] \quad (1)$$

where $\alpha_i$ designates the $\alpha$ parameter; P designates an analysis order; and $\gamma$ designates a weighted coefficient ranging from 0 to 1 and assumed to be $\gamma=0.9$.

The K/$\alpha$ parameter converter 9 calculates the coefficient $\alpha_i$ (i=1, . . . , and P) of the numerator of the equation (1) by using the K parameter from the LPC analyzer 4 and supplies the calculated coefficient to the noise weighted filter 3 and to an attenuation coefficient applicator 10.

This attenuation coefficient applicator 10 multiplies the output of the K/$\alpha$ parameter transformer 9 by the attenuation coefficient $\gamma^i$ to obtain the coefficient $r^i\alpha_i$ (i=1, . . . , and P), i.e., the denominator of the equation (1). The coefficient thus obtained is fed to the noise weighted filter 3.

The noise weighted filter 3 calculates the transmission function W(Z) by using $\alpha_i$ and $\gamma^i\gamma_i$ and develops the convolutional multiplication of the function using the input from the window processor 2 for the auditory weighting. The output thus weighted is fed to a low pass filter 6.

In the preferred embodiment, LPF 6 is a low pass filter for filtering out a frequency component higher than 1 KHz, but the filter may be of any type. A transversal filter is utilized in the present embodiment. The high cut-off frequency of the LPF 6 is set at 0.8 KHz in order to sufficiently attenuate a frequency component higher than 1 KHz but pass a frequency component lower than 1 KHz with as little attenuation as possible.

Figure 2:
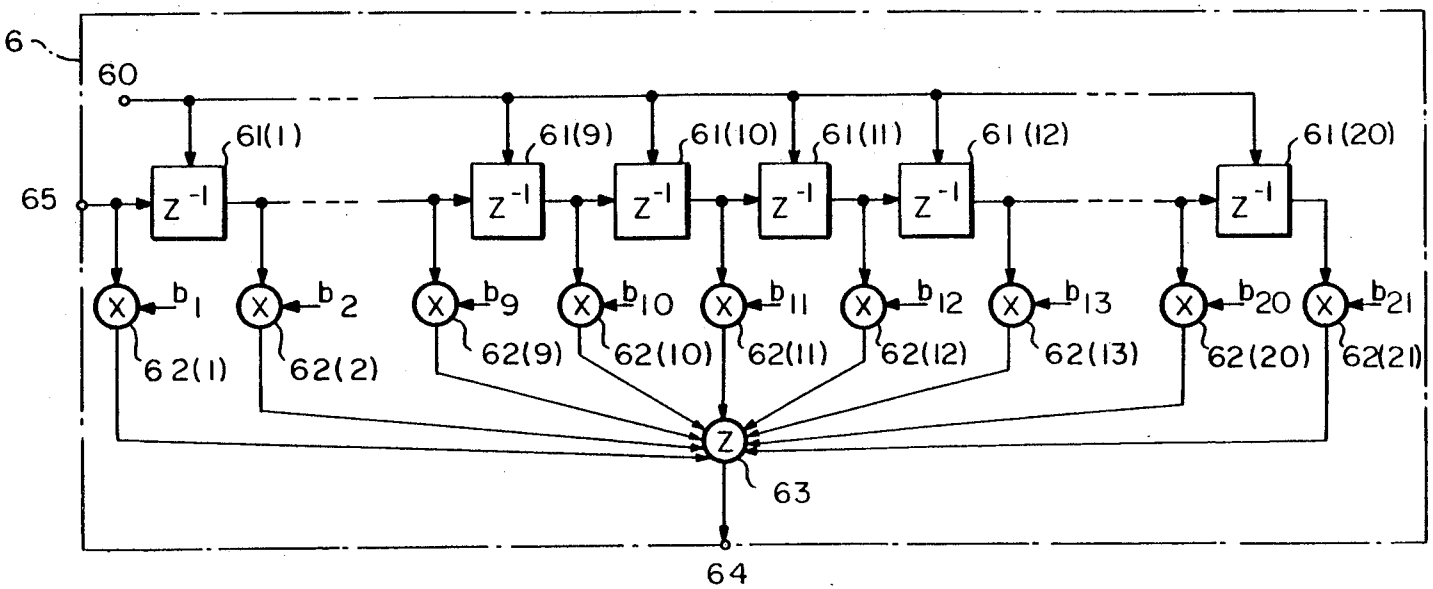
FIG. 2 is a detailed block diagram showing the structure of an LPF 6 of FIG. 1.

FIG. 2 is a block diagram showing one example of the structure of the LPF 6. The LPF 6 shown in FIG. 2 comprises unit delays 61(1) to 61(20), multipliers 62(1) to 62(21) and an accumulator 63.

As sampled speech signal of 8 KHz is supplied through an input terminal 65 to the unit delay 61(1). A sampling clock of 8 KHz is fed through a clock input terminal 60 to the unit delays 61(1) to 61(20). The unit delay 61(1) stores the speech signal supplied at 8 KHz and outputs the stored speech signal to the next unit delay 61(2) (not shown). On the other hand, the unit delay 61(i) (i=2, 3, . . . , and 20) stores the speech signal fed from the unit delay 6l(i-1) and outputs the stored speech signal to the unit delay 61(i+1). Here, the output of the unit delay 61(20) is not inputted to any unit delay.

The speech signal fed to the input terminal 65 is sequentially stored in the unit delays 61(1) to 61(20). The speech signal to the input terminal 65 is also fed to the multiplier 62(1), whereas the signals stored in the unit delays 61(1) to 61(20) are supplied to the multipliers 62(2) to 62(21), respectively. These multipliers 62(1) to 62(21) are fed with filter coefficients $b_1$ to $b_{21}$. These filter coefficients have the relation of $b_i=b_{22-i}$ (i=1, 2, . . . , and 10). It is well known by those skilled in the art that the values of these filter coefficients can be easily determined through the Fourier transformation of the frequency response of the filter. All the outputs of the multipliers 62(1) to 62(21) are supplied to the accumulator 63. The output of the accumulator 63 is supplied as the output of the LPF 6 through an output terminal 64 to a decimator 7.

Figure 4A:
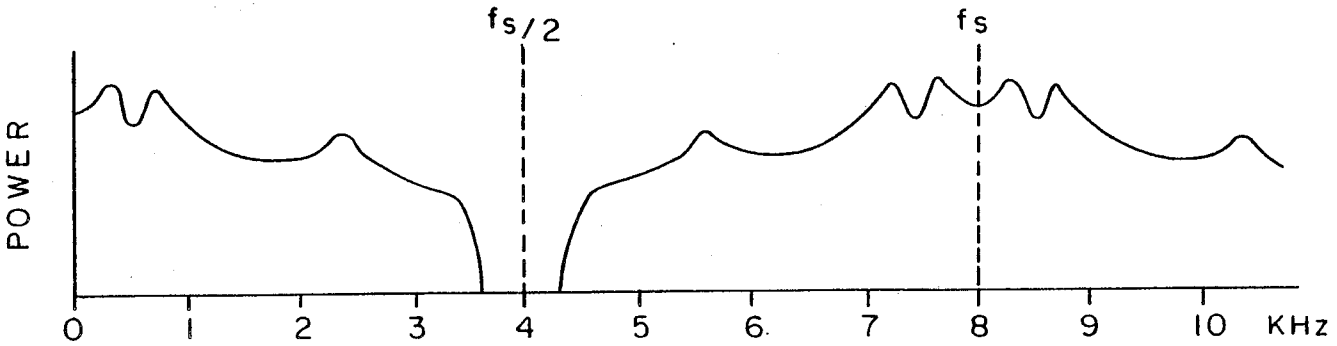
FIGS. 4A through 4D are spectrum diagrams for explaining the operation of the apparatus of FIG. 1.
Figure 4B:
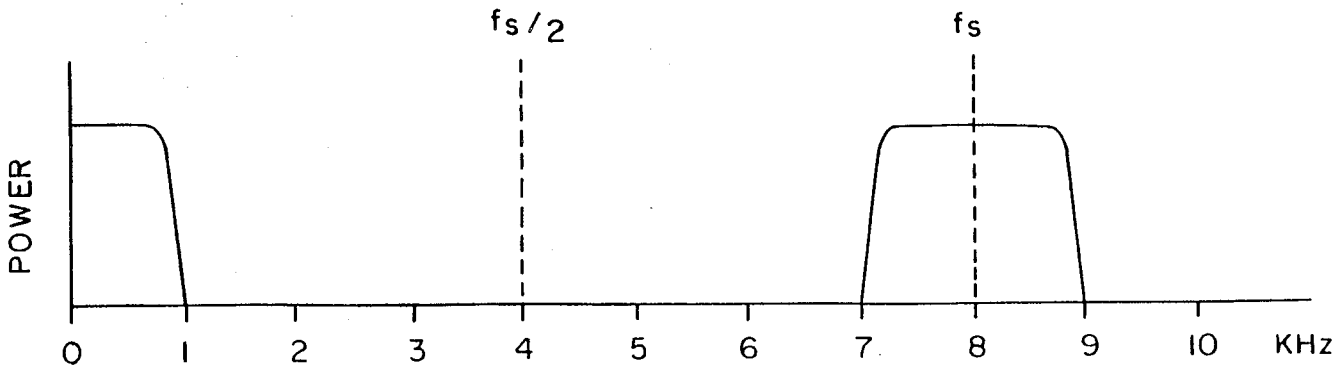
Figure 4C:
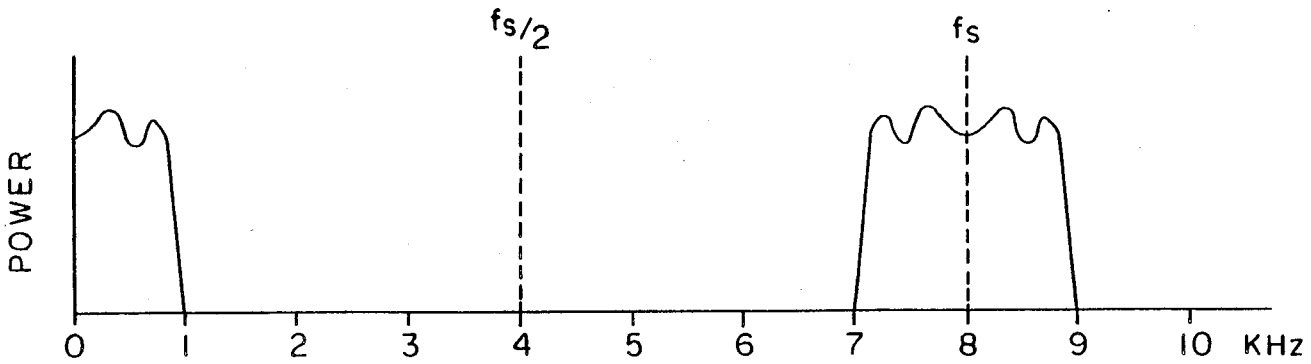

FIGS. 4A to 4C are diagrams showing the frequency characteristics for explaining the function of the LPF 6. In FIGS. 4A to 4C, $f_s$ designates a sampling frequency (8 KHz), and $f_s/2$ designates a reflection frequency. FIG. 4A shows a power spectral envelope of a certain speech signal, that is, the input of the LPF 6. FIG. 4B shows the frequency response of the LPF 6. The output of the LPF 6 has the spectrum of FIG. 4C obtained by low-pass filtering the spectrum of FIG. 4A with the frequency characteristic of FIG. 4B. The output of the LPF 6 is supplied to the decimator 7.

The decimator 7 performs a so-called "decimation", in which the 8 KHz sampled signal having the power spectrum shown in FIG. 4C, for example, is converted into a series of 2 KHz sampled signals. This decimation not only makes easier to develop the multi-pulse but also avoids the undesired LPC analysis for the signal filtered in high fidelity by the attenuation characteristic of the LPF 6 in the neighborhood of the cut-off frequency in the low frequency range of 0 to 1 KHz.

Figure 3:
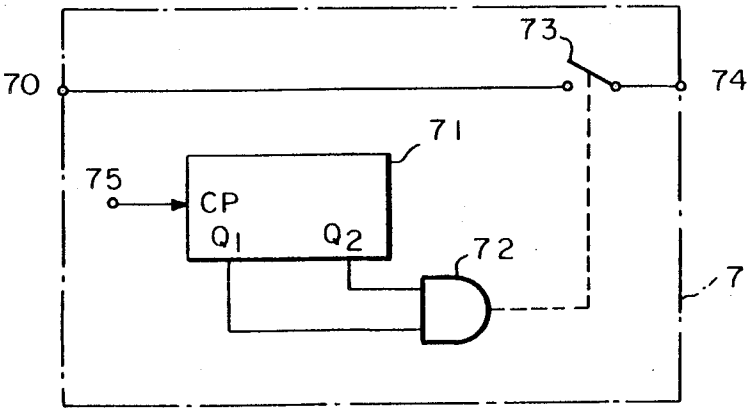
FIG. 3 is a block diagram showing one example of a structure of a decimator 7 of FIG. 1.

FIG. 3 is a block diagram showing one example of the structure of the decimator 7. The decimator 7 includes a counter 71, an AND gate 72 and a switch 73.

Figure 4D:
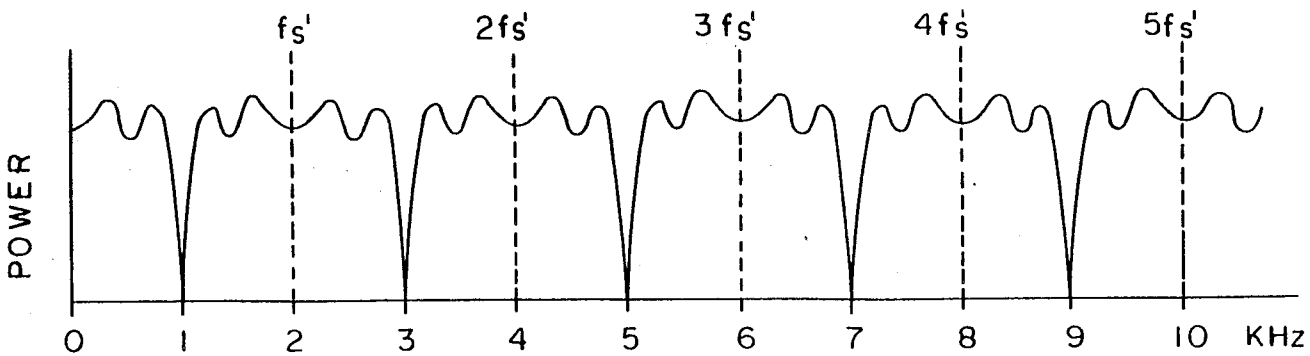
Figures 5A, 5B, 5C, 5D, 5E, 5F:
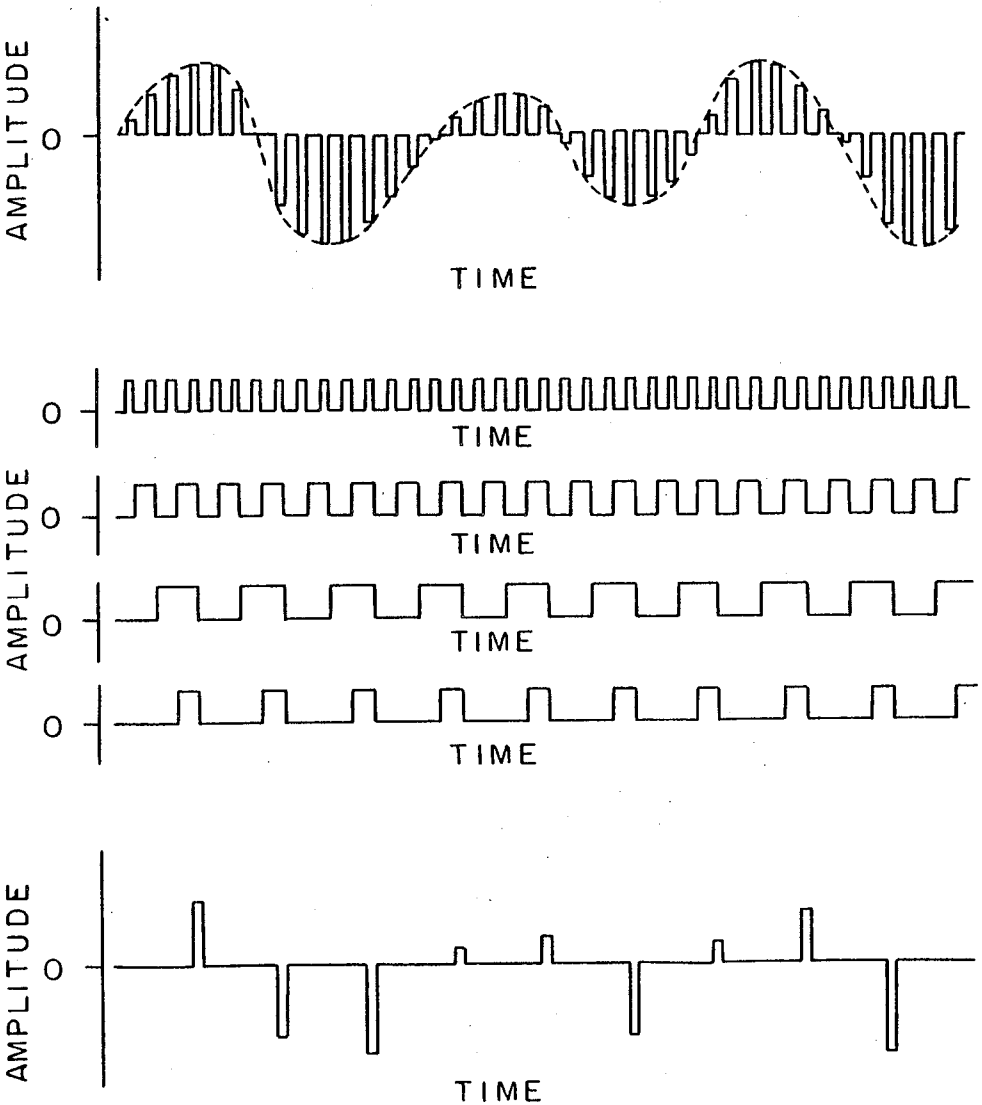
FIGS. 5A through 5F are waveform charts for explaining the operation of the decimator 7 of FIG. 3.

The 8 KHz sampled speech signal having the power spectrum shown in FIG. 4C is supplied through an input terminal 70 to the switch 73. The waveform of this sampled speech signal is shown in FIG. 5A. The 8 KHz sampled clock shown in FIG. 5B is inputted through a clock input terminal 75 to the CP terminal of the counter 71. The counter 71 is a binary counter for sequentially dividing the frequency of the inputted clock. FIGS. 5C and 5D are waveform diagrams showing the outputs of the ½ frequency division terminal Q1 and ¼ frequency division terminal Q2 of the counter 71, respectively. The outputs of the terminals Q1 and Q2 of the counter 71 are fed to the AND gate 72. The AND gate 72 outputs its AND result (shown in FIG. 5E) to the switch 73. The switch 73 is controlled by the AND result to supply one of the four sampled speech signals to an output terminal 74. FIG. 5F shows the waveform at the output terminal 74, which is decimated from the 8 KHz sampled waveform shown in FIG. 5A to one quarter, i.e., 2 KHz. FIG. 4D shows the power spectrum having the signal of FIG. 5F wherein $f_s'$ designates a sampling frequency, i.e., 2 KHz. Incidentally, the spectral changes by the decimation are described in detail in Section 2.4.2 "Decimation" of "Digital Processing of Speech Signals" by L.R. Rabiner/R.W. Schafer, 1978, Prentice-Hall.

The low-frequency data of 0 to 1 KHz outputted from the decimator 7 are fed to an LPC analyzer 8 and a multi-pulse analyzer 100. The LPC analyzer 8 develops the LPC coefficients and supplies the coefficients to a K/$\alpha$ converter 9A. The converted coefficient $\alpha$ is supplied to an attenuation coefficient applicator 10A to supply $\gamma^i\alpha_i$ to the inpulse response calculator 12. The LPC analyzer 8, K/$\alpha$ converter 9A and attenuation coefficient applicator 10A are similar to the above-stated circuits 4, 9 and 10, respectively. The multi-pulses concerning the quantized speech signal of 0 t 1 KHz are extracted as follows.

As well-known multi-pulse extraction techniques, there is usually used either A-b-S (i.e., Analysis-by-Synthesis) processing based on the spectral domain evaluation, see U.S. Pat. No. 4,472,832, or correlation function processing based on the correlation domain evaluation. In the present embodiment, the multi-pulse series is developed by the correlation domain technique.

This technique develops a time location and an amplitude of each of the multi-pulse series capable of expressing the speech exciting source signal through a cross-correlation coefficient between an input speech signal and the impulse response of the LPC synthesis filter. This technique is disclosed in a report "EXAMINATION ON MULTI-PULSE DERIVING SPEECH CODING PROCEDURES", Meeting for Study on Communication System, Institute of Electronics and Communication Engineers of Japan, Mar. 23, 1983, CAS82-202, CS82-161. The LPC analyzer 8 determines the $\alpha$ parameter from the input speech signal in a low frequency range of 0 to 1 KHz and supplies it to the impulse response calculator 12. The impulse response calculator 12 obtains the impulse response by a well known method based on the $\alpha$ parameter.

The LPC analysis is performed to develop the $\alpha$ parameter of 4th order in the low frequency range of 0 to 1 KHz. Here, the reason why the LPC analyzer 8 executes the LPC analysis of the decimated waveform is based on the necessity for extracting the LPC coefficients of the waveform to be subjected to the multi-pulse analysis by the multi-pulse analyzer 100. Of course, if the LPC analysis is performed for the decimated waveform, there can be attained auxiliary effects that the object to be analyzed can be compressed to improve the analysis accuracy and that the unnecessary approximation of the attenuation characteristics due to the characteristics of LPF 6 can be avoided because the range of 1 to 4 KHz of FIG. 4C is directly analyzed.

The LPC coefficients and the multi-pulses are developed as the speech parameters. According to this technique, the coding bit data can be remarkably reduced compared with that of the prior art as follows.

In the conventional multi-pulse development, more specifically, multi-pulses in numbers about 10% as large as that of the total input samples, are developed so that eight multi-pulses are extracted for each analysis frame where there are total samples of 80 by 8 KHz sampling in the analysis frame of 10 msec. In the present invention, on the contrary, the speech signal bandwidth is reduced to one quarter and the sampling frequency used is also decimated to one quarter. Thus, the required number of multi-pulses can be drastically reduced to four pulses for 10 msec. Since the bit number of quantization of the multi-pulse depends upon the number of the multi-pulses and the bit number needed for quantizing one multi-pulse, according to the present invention, the bit number of quantization, that is, the coding bit rate at the analysis side is remarkably reduced.

More specifically, the location data are encoded in the form of expressing the interval of the adjoining multi-pulses. In the conventional multi-pulses development for the whole band, for example, the average pulse interval 10 is obtained from the total samples of 80 for one frame length, i.e., 10 msec and from the pulse number 8 so that 4 bits are required per one pulse for the interval coding. In the present invention, on the contrary, the average pulse interval 5 is obtained from the total samples 20 (=80/4) per 10 msec and from the pulse number 4 so that 3 bits are required per one pulse for the interval coding. If the amplitude of a multi-pulse is expressed by 3 bits in both the prior art and the present embodiment, the multi-pulse quantizing bit numbers necessary for 10 msec are as follows:

| | Multi-Pulse Number | Amplitude Quantization | Location Quantization | Total Bit Number |
|---|---|---|---|---|
| Prior Art | 8 | 3 | 4 | 56 |
| Invention | 4 | 3 | 3 | 24 |

In other words, the present invention makes it possible to reduce the bit rate to as low as (56−24)/0.01=3211 bps. Since, the set number of the multi-pulse per divided subframe of the analysis frame is restricted to 1, for example, in the present invention as will be described below, the pulses can be prevented from being concentrated in a neighborhood segment (in the same subframe) to improve the synthesized quality.

As has been described hereinbefore, according to the present invention, the bit rate is drastically reduced while minimizing the degradation of the synthetic quality. In the present invention, moreover, the following process is executed by the multi-pulse analyzer 100 so as to improve the synthesized quality.

In FIG. 1, the circuit including the impulse response calculator 12 through the pulse quantization encoder 19 develops the multi-pulses by making use of the auditory weighted quantization speech signal outputted from the noise weighted filter 3. In the present embodiment, this multi-pulse development is performed for the respective subframes obtained by dividing the analysis frame of 22.5 msec.

The multi-pulse development in the present embodiment makes use of the method based upon the correlation coefficient.

The difference $\epsilon$ between the synthesized signal with K multi-pulses and the input speech signal is given by the following equation (2):

$$\epsilon = \sum_{n=1}^{N} \left[ Sn - \sum_{i=1}^{k} g_i h_{n-m_i} \right]^2 \tag{2}$$

wherein N designates an analysis frame length, and $g_i$ and $m_i$ designate the amplitude and location of the i-th multi-pulse in the analysis frame, respectively. The pulse amplitude and location giving the minimum difference $\epsilon$ are developed such that the following equation (3) obtained by partially differentiating the equation (2) with respect to $g_i$ and setting the result at 0 takes the maximum:

$$g_i(m_i) = \max_{1 \leqq m_i \leqq N} \left| \frac{\phi_{hs}(m_i) - \sum_{l=1}^{k-1} g_l R_{hh}(|m_e - m_i|)}{R_{hh}(0)} \right| \tag{3}$$

wherein $R_{hh}$ designates the autocorrelation coefficient of the impulse response of the synthesis filter, and $\phi_{hs}$ designates the cross-correlation coefficient between the speech input and the impulse response.

The equation (3) means that the amplitude $g_i(m_i)$ is optimum for the multi-pulse where the pulse is given at the location $m_i$. The amplitude $g_i(m_i)$ is sequentially obtained through correcting the cross-correlation coefficient series by subtracting the second term of the numerator of the equation (3) from the cross-correlation $\phi_{hs}(m_i)$ each time the multi-pulse is determined, subsequently normalizing it by the autocorrelation coefficient $R_{hh}(0)$ at a delay time 0 and detecting the maximum of the normalized absolute value. In this case, the second term of the numerator of the equation (3) is determined on the basis of the amplitude and location information of the maximum developed just prior to the current calculation, the autocorrelation $R_{hh}(|m_e-m_i|)$ at a delay time $|m_e-m_i|$ from that maximum, and the location information in the analysis frame of the pulse to be developed. A cross-correlation coefficient corrector 15 corrects the cross-correlation coefficient appearing in the numerator of the aforementioned equation (3) by using the cross-correlation coefficient $\phi_{hs}$ from a temporary memory 14, the information concerning the amplitude and location of the maximum $\phi_{hs}$ from a maximum value location 16, the information concerning the autocorrelation coefficient from an autocorrelation coefficient calculator 13, and the location information in the analysis frame of the pulse to be developed from a subframe status memory 17. Then, the corrected cross-correlation data is normalized with $R_{hh}(0)$ and the normalized data is supplied to a temporary memory 14.

The maximum value detector 16 sequentially detects the maximum of the corrected cross-correlation coefficient data and supplies the maximum ones as the multi-pulses to the cross-correlation coefficient corrector 15 and a multi-pulse temporary memory 18.

This maximum development method is sequentially executed for each analysis frame. In the present embodiment, however, this analysis frame is divided into twelve subframes and the multi-pulse development is performed for the respective subframes. The subframe where the multi-pulse has been developed is sequentially precluded from the subframes for development and only the subframes where no multi-pulse is has been are used. The twelve number of the subframes is set at a smaller value than the number obtained by dividing the analysis frame by the minimum pitch period considerable as input speech. In the case of the present embodiment, the analysis frame length is 22.5 msec, and the subframe length is accordingly $22.5/12=1.875$ (msec) or about 533 Hz in frequency. This value is far shorter than the maximum pitch period of the input speech so that at most one multi-pulse is set at the respective subframes.

Now, the subframe status memory 17 gives the status representative of whether or not in each of the twelve subframes the multi-pulse is developed by the maximum value detector 16. The maximum value detection may be performed only for the so-called "time slot", i.e., the corresponding time range of the subframe where no multi-pulse has been developed. The subframe status memory 17 may be a RAM for storing twelve words representative of the twelve subframes. These twelve words are stored at 0-th through 11-th addresses to assign time slots 1 to 15, 16 to 30, . . . , and 166 to 180. Each of these time slots is the time range, including 15 sampled points, which is prepared, by dividing the 180 sampled points in one analysis frame of 22.5 msec by the 8 KHz sampling frequency.

The contents of the multi-pulse temporary memory 18 is initialized to "0" each analysis frame and is set at "1" at an address where the multi-pulse has been developed. A set "1" address corresponding to the subframe is precluded from the addresses for developing the multi-pulse. The maximum value detector 16 detects the maximum by making use of the subframe status information from the subframe status memory 17.

Thus, the maximum value detection is performed for each analysis frame through that for each subframe and is repeated until the number of developed multi-pulses comes to a predetermined number. The information concerning the location and amplitude thus retrieved is stored in the multi-pulse temporary memory 18.

The multi-pulses stored in the multi-pulse temporary memory 18 are then read out and supplied to a pulse quantization encoder 19 wherein they are quantized and encoded in a predetermined form for each analysis frame.

Figure 6:
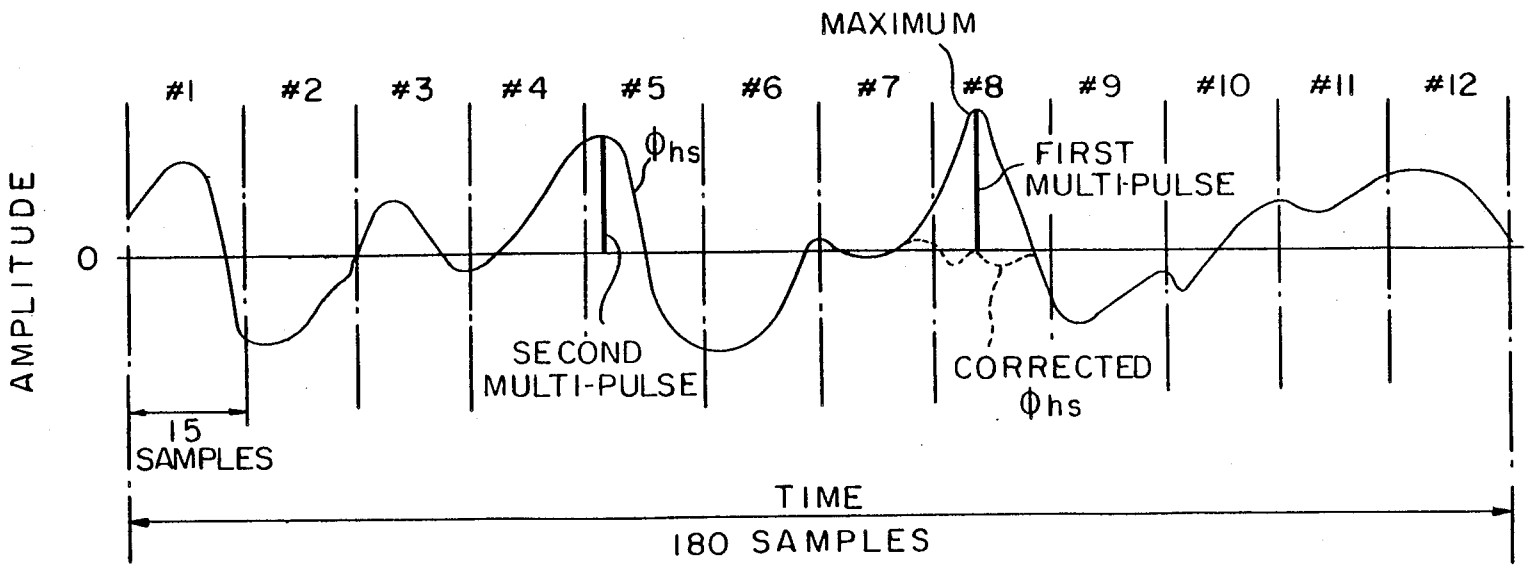
FIG. 6 is a diagram for explaining the operation of an embodiment of the present invention in which an analysis frame is divided into subframes.

The multi-pulse developing procedure making use of the subframes will be described with reference to FIG. 6. FIG. 6 shows a time series of the cross-correlation coefficients, in which the 180 samples of one frame are divided into the twelve subframes (each containing 15 samples) and numbers #1 to #12 are assigned to the respective subframes. The development of the multi-pulses is performed through detecting the maximum and its location of the cross-correlation coefficient (at the subframe #8) as the first multi-pulse, correcting the cross-correlation coefficient series around the location of the maximum with the autocorrelation coefficient, and detecting the maximum and its location of the range except the subframe #8 to determine the second multi-pulse (at the subframe #5). The cross-correlation series around the location of this second multi-pulse is then corrected with the autocorrelation coefficient, and the maximum of the range, except the subframes #8 and #5, is then similarly detected to sequentially determine the other multi-pulses.

Figure 7:
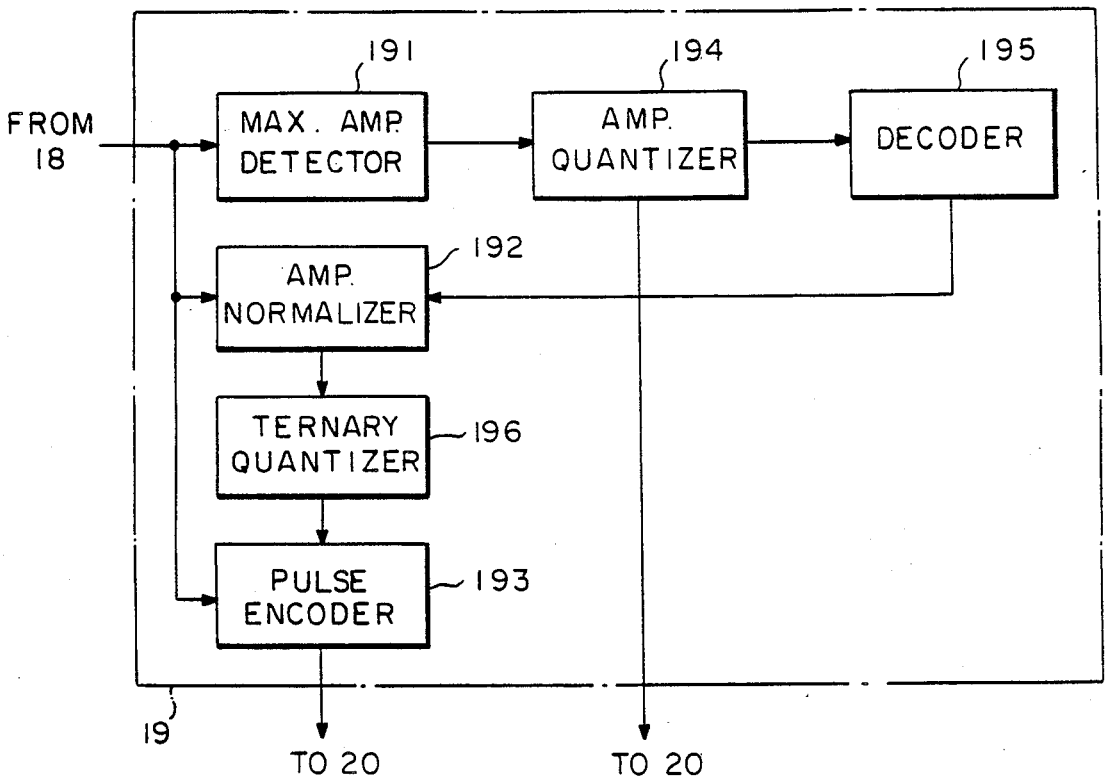
FIG. 7 is a block diagram showing one example of the structure of a pulse quantizing encoder 19 of FIG. 1.

FIG. 7 is a block diagram showing a detailed example of the quantizing encoder 19 of the embodiment in FIG. 1. The quantizing encoder 19 comprises a maximum amplitude pulse locator 191, a pulse amplitude normalizer 192, a pulse encoder 193, an amplitude quantizer 194, a decoder 195 and a ternary quantizer 196.

In the present embodiment, the input speech is analyzed at the bit rate of 4,800 bps and is fed to the synthesis side. As a result, 108 bits are given for one analysis frame length of 22.5 msec. The assignment and distribution of the 108 bits are set as follows: for the pulse location and polarity, 5 bits are assigned to each subframe, i.e., 60 bits to each analysis frame; 7 bits are assigned to the maximum pulse amplitude of each analysis frame; 40 bits are assigned to the LPC coefficients ($K_1$ to $K_{10}$); and 1 bit is assigned as the frame synchronizing bit.

The multi-pulses read out from the multi-pulse temporary memory 18 are supplied to the maximum amplitude pulse locator 191, the pulse amplitude normalizer 192 and the pulse encode 193.

The maximum amplitude pulse detector 191, supplied with the multi-pulse series thus developed, detects the maximum value in each analysis frame and supplies it to the amplitude quantizer 194.

The amplitude quantizer 194 logarithmically compresses the maximum value by utilizing a transformation formula $\mu$-low so as to compress the dynamic range of the speech amplitude information. Here, the compression parameter may be $\mu=255$. This makes it possible to perform the positive side compression with the $\mu$-low so that 1 bit can be accordingly omitted to quantize the amplitude with 7 bits.

The maximum amplitude information outputted from the amplitude quantizer 194 is encoded in a predetermined way and is fed to the multiplexer 20 and the decoder 195. The decoder 195 decodes the coded maximum amplitude information and supplies it to the pulse amplitude normalizer 192. The pulse amplitude normalizer 192 exponentially extends the nonlinearly compressed maximum amplitude in each analysis frame to restore the original amplitude and to normalize the multi-pulses using the extended maximum amplitude, and supplies its output to the ternary quantizer 196.

Figure 8:
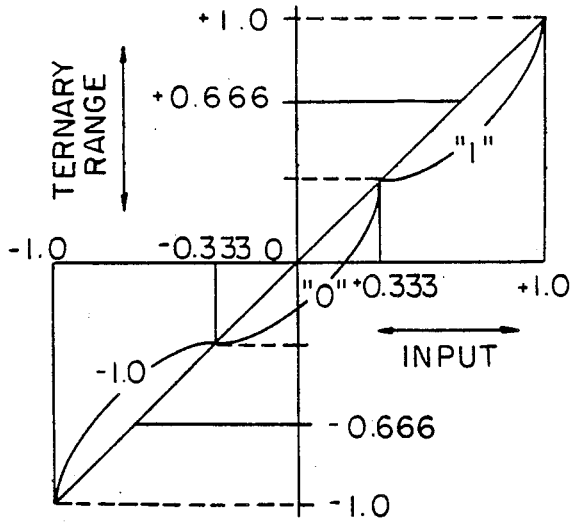
FIGS. 8 and 9 are diagrams explaining one embodiment of the present invention utilizing the subframe division.

The ternary quantizer 196 subjects the normalized multi-pulse amplitude thus inputted to the following ternary quantization. FIG. 8 is a characteristic curve showing the ternary quantization for explaining the ternary quantization.

The input indicated on the abscissa is the normalized multi-pulse amplitude supplied from the pulse amplitude normalizer 192 and distributed over a range of +1.0 to −1.0 in accordance with the polarity and amplitude of the multi-pulses. The ternary quantization is conducted by expressing the three divisions of that range with three logical values "1", "0" and "−1".

In the present embodiment, all the amplitudes within a range from +0.333 to −0.333, i.e., one third level of the normalized level are given the logical value "0". This is because the multi-pulses having amplitudes lower than a certain level are substantially unnecessary for the speech synthesis.

All the inputs within the range from +0.333 to +1.0 are expressed with the logical value "1". On the other hand, all the inputs within the range from −0.333 to −1.0 are expressed with the logical value "−1.0". The ordinate of FIG. 8 indicates the range of the ternary logical values expressed to correspond to inputs and the relations between those inputs and the ternary range are plotted in the ternary characteristic curve in FIG. 8.

The amplitudes of the multi-pulses thus ternarily quantized are supplied to the pulse encoder 193. The pulse encoder 193 encodes the multi-pulse data including its location and supplies the encoded data to the multiplexer 20.

In the pulse quantization and encoding described above, the coding of the ternary multi-pulses uses 4 bits as the location information and 1 bit as the amplitude information to express the information of the normalization and ternary amplitude and location of the multi-pulses with a total of 5 bits. The location information is determined for each subframe in the analysis frame. Of the values 0 to 15 expressed in 4 bits, the number fifteen of 1 to 15 is used to address the time slots, i.e., the locations of the multi-pulses in a manner to correspond to the 1st to 15th time slots of each subframe, and the remaining one, 0, is used to address the amplitude in case this amplitude takes the ternary logical value "0". The 1 bit assigned for the amplitude is used to designate that the value 0 is the ternary logical value "1", i.e., that the polarity is positive, and the value 1 is the ternary logical value "−1", i.e., that the polarity is negative.

The multiplexer 20, supplied with the K parameter of tenth order, the maximum amplitude of the multi-pulses, and the normalized multi-pulses expressed with the ternary logical values, i.e., the ternary multi-pulses, combines and multiplexes these inputs suitably in a predetermined way and sends the multiplexed data at a bit rate of 4,800 bps to the synthesis side through a transmission line 30.

Figure 9:
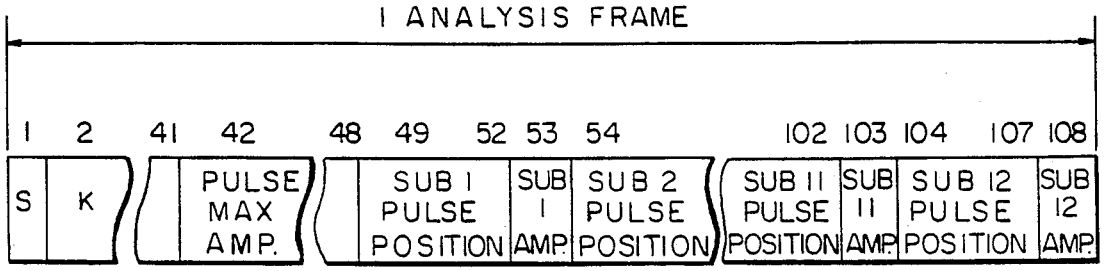

FIG. 9 is view for explaining the bit assignment in the speech parameter coding at the analysis side.

One bit, a 1st bit, is assigned to the frame synchronization bit S of each analysis frame, and forty bits from 2nd to 41st bits are assigned to the K parameter of tenth order as the LPC coefficients bits K. Seven bits from 42nd to 48th bits are assigned to the maximum amplitude of the multi-pulses. For the multi-pulses to be developed for twelve subframes, moreover, four bits from 49th to 52nd bits are utilized as the pulse location information for a first subframe SUB1, for example, and the numerical value 0 of those expressed with the four bits is utilized to designate the amplitude 0. The amplitude of the SUB1 expresses +1 or −1 by the 1 and 0 of the one bit at the 53rd. Thus the quantization and encoding for the amplitude bit up to the twelfth subframe SUB12 are performed with 108 bits.

Figure 10:
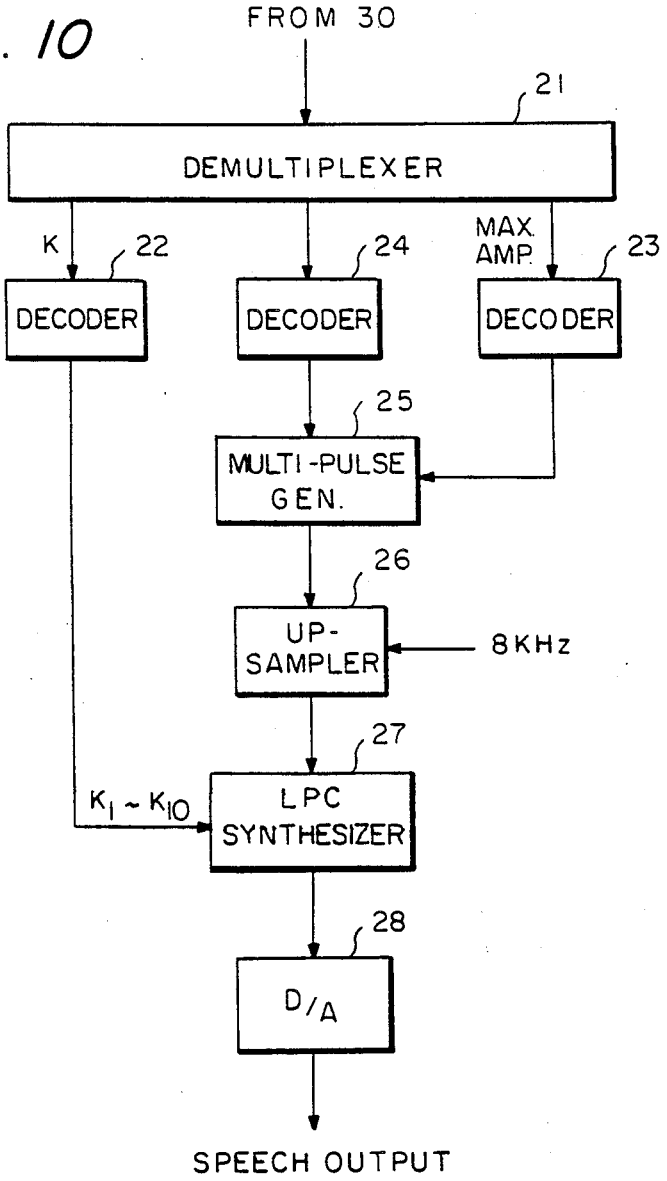
FIG. 10 is a block diagram showing an example of a structure of one embodiment at a synthesis side.

The synthesis side shown in FIG. 10 will be described in connection with its operation.

A demultiplexer 21 demultiplexes the multiplexed signals sent from the analysis side through the transmission line 30 to supply the K parameter of each analysis frame to a decoder 22, the maximum amplitude of the multi-pulses of each analysis frame to a decoder 23, and the information concerning the location and amplitude of the ternary multi-pulses of each analysis frame to a decoder 24.

The decoder 22 decodes the coded input K parameter to supply these K parameters $K_1$ to $K_{10}$ of tenth order to an LPC type synthesizer 27.

This LPC type synthesizer 27 is a speech synthesizer utilizing an all-pole type digital filter and the synthesizer 27 uses the input K parameter as its filter coefficient.

The decoder 23 decodes the coded maximum amplitude and exponentially extends it to restore the original maximum amplitude information before the nonlinear compression at the analysis side. The information thus restored is supplied to a multi-pulse generator 25.

The decoder 24 decodes the coded ternary multi-pulses, denormalizes the decoded multi-pulses by using the maximum amplitude received from the decoder 23, and supplies the multi-pulse series developed, at most one in each subframe, to an up-sampler 26.

To the up-sampler 26, there is supplied the multi-pulse series which is freely located at an irregular interval on principle and which has a sampling interval of 2 KHz and one sample in five sample positions on average. The up-sampler 26 up-samples the sampling interval of 2 KHz to the sampling interval of 8 KHz by inserting three samples at 0 value between every two samples of the train of 2 KHz, for example. As a result of this up-sampling, the multi-pulse series is converted into the irregular interval pulse series, which has the sampling interval of 8 KHz and one sample in 20 sample positions on average.

Of course, if a sample series of an equal inverval is to be up-sampled, for example, the spectrums of FIG. 4D are converted into those of FIG. 4C, no effective spectrum in the higher frequency is generated. However, the irregular pulse series, as the multi-pulses, intrinsically has a frequency component in an infinite frequency range so that all its frequency components are reflected and confined within the range of 0 to 1 KHz. According to this up-sampling, the multi-pulses in the low frequency range of 0 to 1 KHz are converted into those containing the spectrum of higher frequencies. The up-sampler 26 outputs the multi-pulses thus formed as the exciting source input of the LPC synthesizer 27.

The LPC synthesizer 27 is an LPC synthesis filter comprising an all-pole type digital filter and uses the LPC coefficients supplied from the decoder 22 as its filter coefficients. The LPC synthesizer 27 is driven by the multi-pulses received from the up-sampler 26 to generate a digital speech signal. In this case, as has been described hereinbefore, the speech exciting source for driving the LPC synthesizer 27 is prepared to contain a component of 0 to 4 KHz by up-sampling the multi-pulse series obtained by analyzing the speech signal lower than 1 KHz. Of these components, the component of 0 to 1 KHz retains the features of the input speech waveforms at least within the range of 0 to 1 KHz. The synthesis filter 27, supplied with the LPC coefficients calculated by the LPC analyzer 8 and driven with the 2 KHz sample frequency, generates a speech replica coincident with the input speech waveform.

It should be noted here that in the present embodiment the LPC synthesizer 27 is controlled by the LPC coefficients analyzed from the data ranging 0 to 4 KHz by the LPC analyzer 4 and is dependent upon the LPC coefficients analyzed from the data ranging 0 to 1 KHz by the LPC analyzer 8. Since the frequency characteristics specified by the coefficients determined by the LPC analyzers 4 and 8 are different for the range of 0 to 1 KHz, the output waveform from the LPC synthesizer 27 is different from the input speech waveform even for the component of 0 to 1 KHz. From the waveform view point, although there is a difference from the output of the LPC synthesis filter at the analysis side, the digital filter of an all-pole type intrinsically needs the minimum phase shift. Therefore, the auditory feature continuity of the input speech signal can be said to be substantially retained so that there is caused no series problem in the synthesis quality for practical applications. In other words, the power spectrum of the speech is reproduced in high fidelity for the range of 0 to 1 KHz. For the components of 1 to 4 KHz, on the contrary, the power spectral envelope of the speech is reproduced in high fidelity on the basis of the frequency characteristics of the LPC synthesizer 27, but not the fine structure of the power spectra. Intrinsically, the higher frequency components of the speech signal has neither a clear structure nor an auditory importance, therefore, there is caused no noticeable problem.

The digital speech signal of the LPC synthesizer 27 thus reproduced are then fed to a D/A converter 28. The D/A converter 28 converts the input into an analog signal and cuts-off the higher frequency components, higher than 3.4 KHz, by the LPF to send the filtered signal as output speech signals.

Thus, the speech exciting source information is represented by the multi-pulse series in a frequency range lower than 1 KHz, thereby reducing the coding bit rate.

In the present embodiment, the vocoder can be operated at the coding bit rate of about 4,800 bps, which is far lower than that of the conventional multi-pulse vocoder. More specifically, the multi-pulse series is transmitted at 3,200 bps, and the other information, such as the LPC coefficients is transmitted at the remaining 1,600 bps. Moreover, the quality of the synthesized speech is far better than that of the vocoder, due to the utilization of the multi-pulses expressing the waveform information.

In the embodiment described above, it is apparent that the LPC analysis order and the LPC coefficients can be arbitrarily set while taking the object of the apparatus into consideration. The LPF 6 and the decimator 7 are shown in independent blocks, but similar functions can be obtained by driving the LPF 6 at a ratio of one sample for four samples.

As has been described hereinbefore, according to the present invention, multi-pulses of irregular intervals obtained by analyzing the predetermined low frequency component of the input speech signal are transmitted from the analysis side, making it possible to realize a speech analysis and synthesis apparatus which can drastically improve the synthesized speech quality at a low coding bit rate.

According to the present invention, moreover, synthesized speech having an excellent quality can be obtained for the reasons summarized in the following even at a bit rate as low as 4,800 bps. The analysis frame is divided into a plurality of subframes. The multi-pulses are developed under a condition not exceeding one multi-pulse for each subframe and the developed multi-pulses are quantized with the ternary logical values of "1" and "−1", including "0". It is possible to avoid the problems accompanying the difficulty in the accurate pitch extraction and to get a much higher S/N than the conventional vocoder because of utilizing unique multi-pulse information having polarity. By conducting the quantization including the value "0", it is possible to eliminate the unnecessary minute pulses which might otherwise raise problems if the pulse series giving only polarity were used.

I claim:

1. A speech processing apparatus, comprising:

an analog-to-digital (A/D) converter for converting an analog input speech signal for each of a plurality of analysis frames having a predetermined time interval into a digitized sampled signal with a first sampling frequency:

first spectrum detecting means for detecting spectrum information of said digitized sampled signal in said analysis frames to produce a first spectrum signal representative of said spectrum information of said digitized sampled signal;

filter means for filtering said digitized sampled signal to produce a filtered speech signal which is weighted by said first spectrum signal and restricted within a first frequency band smaller than that of said input speech signal;

a decimator for converting said filtered speech signal into a decimated speech signal with a second sampling frequency smaller than that of said first sampling frequency;

second spectrum detecting means for detecting spectrum information of said decimated speech signal in said analysis frames to produce a second spectrum signal representative of said spectrum information of said decimated speech signal; and multi-pulse developing means responsive to said decimated speech signal for developing a plurality of multi-pulses each having an amplitude and a location representative of speech exciting source information of said decimated speech signal.

2. A speech processing apparatus according to claim 1, wherein said first sampling frequency is 8 KHz and said second sampling frequency is 2 KHz.

3. A speech processing apparatus according to claim 1, wherein said digital filter has a high cut-off frequency of 0.8 KHz.

4. A speech processing apparatus according to claim 1, wherein said first spectrum detecting means is a first LPC analyzer for determining linear predictive coefficients (LPCs) of said input speech signal.

5. A speech processing apparatus according to claim 1, wherein said multi-pulse developing means includes: an impulse response calculator for determining an impulse response of a filter specified by said second spectrum signal; a cross-correlation coefficient calculator for determining cross-correlation coefficients between the outputs of said impulse response calculator and said decimator; an autocorrelation coefficient calculator for determining autocorrelation coefficients of the output of said impulse response calculator; and means for developing said multi-pulses on the basis of the outputs of said cross-correlation coefficient calculator and said autocorrelation coefficient calculator.

6. A speech processing apparatus according to claim 5, wherein said second spectrum detecting means is a second LPC analyzer for determining the linear predictive coefficients of said decimated speech signal to supply said linear predictive coefficients to said impulse response calculator.

7. A speech processing apparatus according to claim 5, wherein said multi-pulse developing means includes:

subframe processing means for determining a plurality of subframes obtained by dividing each of said analysis frames into a plurality of subframes, and means for developing at most one multi-pulse in one subframe.

8. A speech processing apparatus according to claim 7, wherein said subframe processing means further comprises means for extracting a pitch from each of said decimated speech signals as extracted pitches; and means for setting a length of said subframe at a value smaller than the minimum pitch of said extracted pitches.

9. A speech processing apparatus according to claim 7, wherein said subframe processing means further comprises a status memory for storing a status indicating whether or not said at most one multi-pulse is set within each of said subframes.

10. A speech processing apparatus according to claim 7, wherein said subframe processing means further comprises an amplitude normalizing and quantizing means for normalizing the amplitude of the developed multi-pulses and for quantizing the normalized amplitude into quantized data assigned to an amplitude range, of a plurality of ranges, prepared in advance to which the normalized amplitude belongs.

11. A speech processing apparatus according to claim 10, wherein the plurality of ranges of said normalized amplitude are three ranges to which values of "+1", "0" and "−1" are assigned.

12. A speech processing apparatus according to claim 1, wherein said multi-pulse developing means includes means for nonlinearly compressing the amplitude of said developed multi-pulses.

13. A speech processing apparatus according to claim 1, wherein said decimator includes: a frequency divider for dividing said first sampling frequency to produce a divided signal; and a switch, supplied with said filtered speech signal and controlled by said divided signal, for intermittently outputting said decimated speech signal.

14. A speech processing apparatus according to claim 1, further comprising:

multi-pulse generating means, supplied with the output of said multi-pulse developing means, for decoding said multi-pulses; and an up-sampler for converting the decoded multi-pulses into sampled data of said first sampling frequency.

15. A speech processing apparatus according to claim 14, further comprising: a speech synthesizer, supplied with said first spectrum signal and with the output of said up-sampler, for outputting a replica speech signal.

16. A speech processing apparatus according to claim 15, further comprising a digital-to-analog (D/A) converter for converting said replica speech signals into analog signals.

17. A speech processing method comprising the steps of:

analog-to-digital converting an analog input speech signal for each of a plurality of analysis frames having a predetermined time interval into a digitized, sampled signal with a first sampling frequency;

detecting spectrum information of said digitized sampled signal in said analysis frames to produce a first spectrum signal representative of said spectrum information of said digitized sampled signal;

filtering said digitized sampled signal to produce a filtered speech signal which is weighted by said first spectrum signal and restricted within a first frequency band smaller than that of said input speech signal;

decimating said filtered speech signal into a decimated speech signal with a second sampling frequency smaller than said first sampling frequency;

detecting spectrum information of said decimated speech signal in said analysis frames to produce a second spectrum signal representative of said spectrum information of said decimated speech signal; and developing a plurality of multi-pulses each having an amplitude and a location representative of speech exciting source information of said decimated speech signal in accordance with said second spectrum signal.

* * * * *